US005535497A

United States Patent [19]

Huang

[11] Patent Number: 5,535,497

[45] Date of Patent: Jul. 16, 1996

[54] HIGH SPEED AUTOMATIC TERMINAL-PRESSING MACHINE

[76] Inventor: Chin-Ting Huang, No. 308, Ta-Feng Second Rd., San-Min Dist. Kaohsiung, Taiwan

[21] Appl. No.: 328,703

[22] Filed: Oct. 25, 1994

[51] Int. Cl.[6] ..... H01R 43/00

[52] U.S. Cl. ..... 29/33 F; 29/874

[58] Field of Search ..... 29/33 F, 874, 29/566.1, 566.2; 140/139, 105, 106; 72/452

[56] References Cited

U.S. PATENT DOCUMENTS 4,513,499 4/1985 Roldan ..... 29/874

FOREIGN PATENT DOCUMENTS 2504743 10/1982 France ..... 29/33 F 620830 5/1961 Italy ..... 29/874

*Primary Examiner*—William Briggs

*Attorney, Agent, or Firm*—Beveridge, DeGrandi, Weilacher & Young

[57] ABSTRACT

A high speed automatic terminal-pressing machine for processing terminals of a socket, comprising a wire reel bracket, an embossing mold, a cutting mold, a clamping member and driving mechanisms for driving the respective components which are driven by a main driving device to synchronously operate in a specifically relatedly sequence, whereby the relative up and down and clamping movement of the embossing mold, cutting movement of the cutting mold and the up and down movement of the clamping means are performed in a predetermined sequence and the wire embossing, insertion and cutting steps of the processing procedure of the work piece are accomplished in a unified and automatic manner.

16 Claims, 11 Drawing Sheets

HIGH SPEED AUTOMATIC TERMINAL-PRESSING MACHINE

BACKGROUND OF THE INVENTION

The present invention relates to a high speed automatic terminal-pressing machine, and more particularly to a machine which is able to perform the wire embossing, insertion, cutting, punching and bending operations in a unified precedure.

Conventionally, the operation of connecting the terminals with the socket (pin insertion) is performed manually in a pressing manner. The efficiency of such operation is poor and the production amount cannot be effectively increased. Although an electrically driven pin insertion machine is currently available, the function of such machine is limited to the pin insertion operation while the pre-works and subsequent punching and bending operation necessary for the pin insertion operation cannot be performed in a unified procedure. Therefore, a mass production is still unavailable to reduce the cost. Moreover, because multiple processing procedures is required, much labor and energy as well as many equipments are necessary. This leads to increased cost and forms an obstacle to the development of the relevant technique.

It is therefore necessary to provide an improved terminal-pressing machine to eliminate the above shortcomings and achieve the objects of time-saving, labor-saving and mass-production so as to reduce the manufacturing cost.

SUMMARY OF THE INVENTION

It is therefore a primary object of the present invention to provide a high speed automatic terminal-pressing machine which is able to perform the wire embossing, insertion, cutting, punching and bending operations of the socket manufacturing procedure in a unified and automatic manner.

It is a further object of the present invention to provide the above terminal-pressing machine which can modified to meet the requirements of different kinds of products and bending angles so as to achieve the automatic mass-production.

It is still a further object of the present invention to provide the above terminal-pressing machine in which the embossing mold and cutting mold can be replaced according to the pattern of the product.

The present invention can be best understood through the following description and accompanying drawings, wherein:

DETAILED DESCRIPTION OF THE PREFERRED EMBODIMENT

Figure 1:
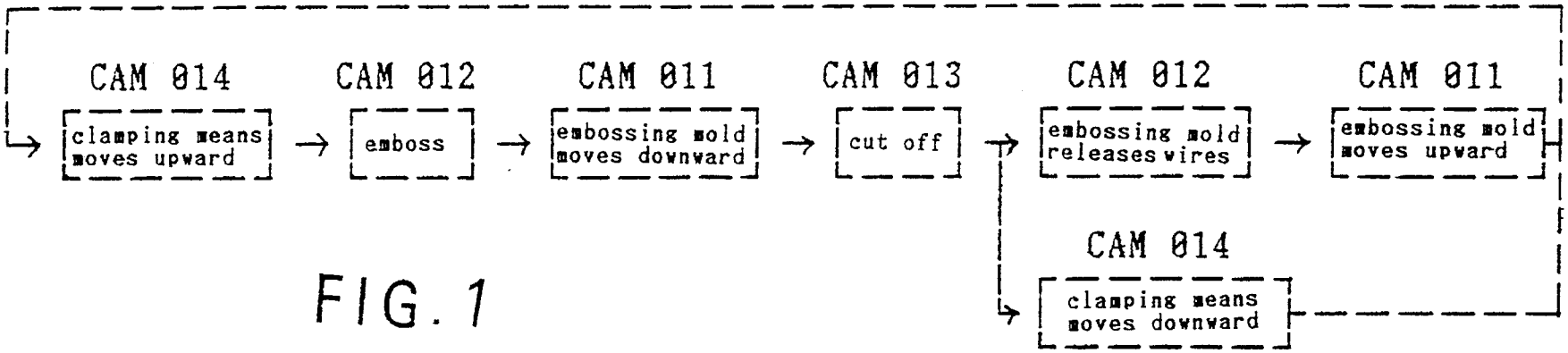
FIG. 1 is a processing flow chart of the present invention.

Please refer to FIG. 1 which is an operation flow chart of the present invention, showing the pin insertion operation and the pre-works thereof. Each block represents an operation and is denoted by a symbol indicative of the driving cam for the operation, wherein CAM011, CAM012, CAM013 and CAM014 respectively represent the pin insertion cam 11, embossing cam 12, cutting cam 13 and clamping means cam 14.

Figure 2:
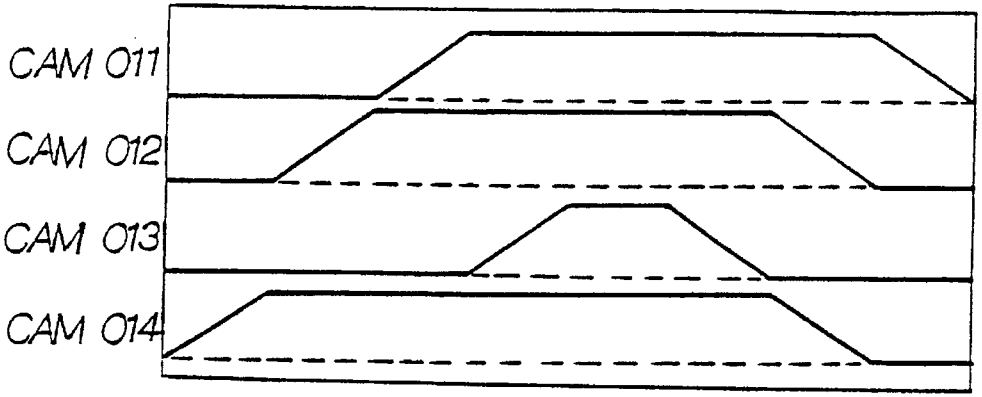
FIG. 2 is a clock diagram of the cams of the present invention.

FIG. 2 is a clock diagram of the four main driving cams for the above four operations, wherein the enabling state and relative operation sequence of the cams are shown in accordance with FIG. 1 for reference.

Figure 3:
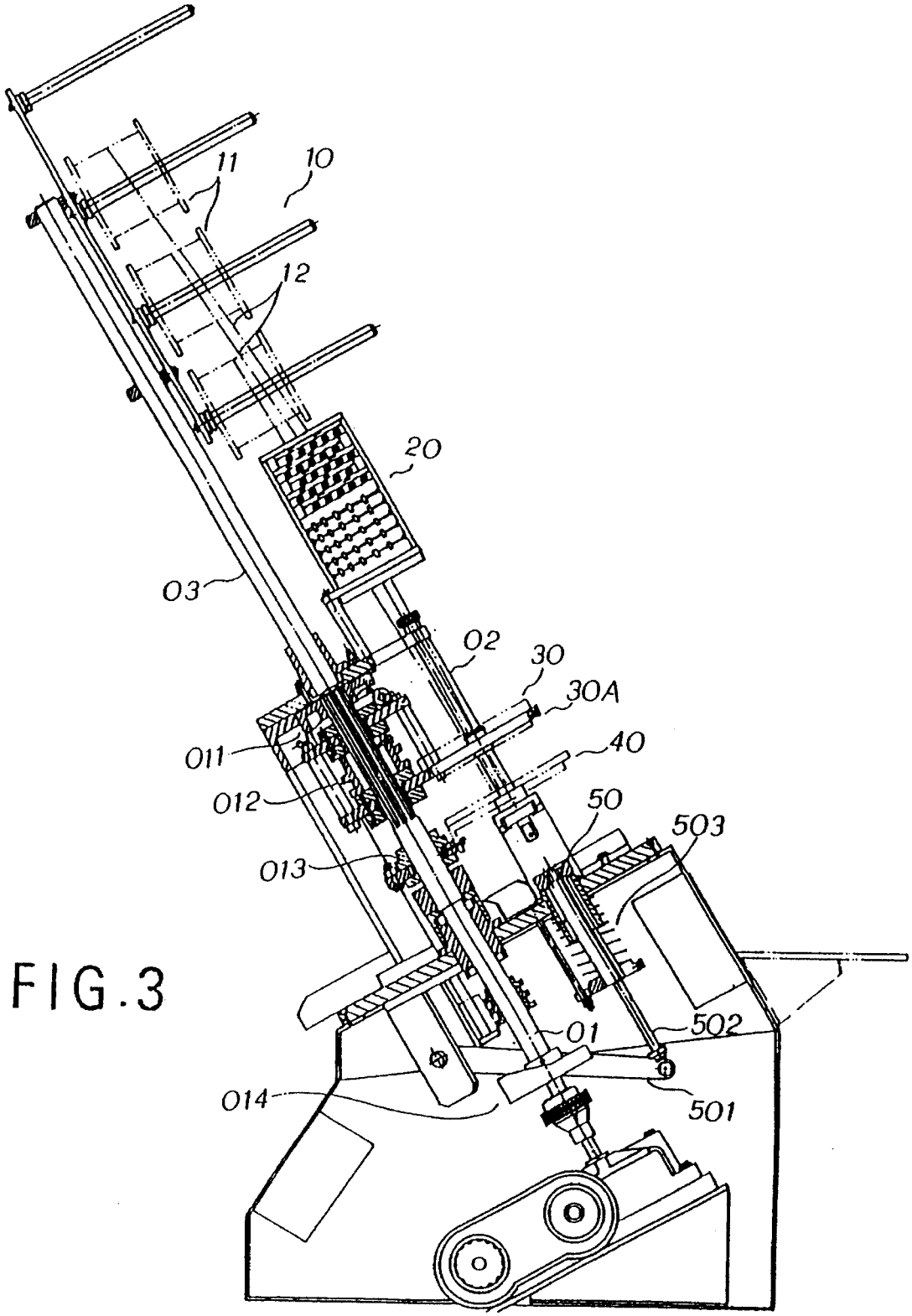
FIG. 3 is a longitudinal sectional view of the present invention.

Please refer to FIG. 3 which shows the structure of the present invention and the relationship between the respective components thereof. Several wire reels 11 are disposed on a wire reel bracket 10 which is fixed at one end of an inclined wire reel support arm 3 to rotatably support the wire reels 11 without slipping. A wire rectifying assembly 20 is disposed under the wire reel bracket 10, having multiple layers of permutated rollers for rolling on and rectifying the bent wires 12 into straight wires and sending the same to an embossing mold 30. The embossing mold 30 is disposed under the wire rectifying assembly 20 to receive the wires 12 and not only emboss but also clamp the wires when pulling the same. The embossing mold is replaceably fixed on the embossing mold seat 30A and driven by the embossing cam 12. The embossing mold seat 30A is limited by the main shaft 1 and slide column 2 to slide up and down and is driven by the pin insertion cam 11. A cutting mold 40 is disposed under the embossing mold 30 to receive the embossed wires 12. The cutting mold 40 is fixed on the slide column 2 and is driven by a rear cutting cam 13 to cut off the wires. In addition, a clamping means 50 is disposed under the cutting mold 40 and is driven by a clamping means cam 14 in such a manner that the clamping means cam 14 drives a swinging arm 501 to drive an abutting rod 502, whereby in cooperation with a restoring spring 503, the clamping means 50 disposed at the top end of the abutting rod 502 is reciprocated up and down. The aforesaid pin insertion cam 11, embossing cam 12, cutting cam 13 and clamping means cam 14 are fixed on the main shaft 1 in sequence and are driven by a motor to synchronously operate.

Figure 4:
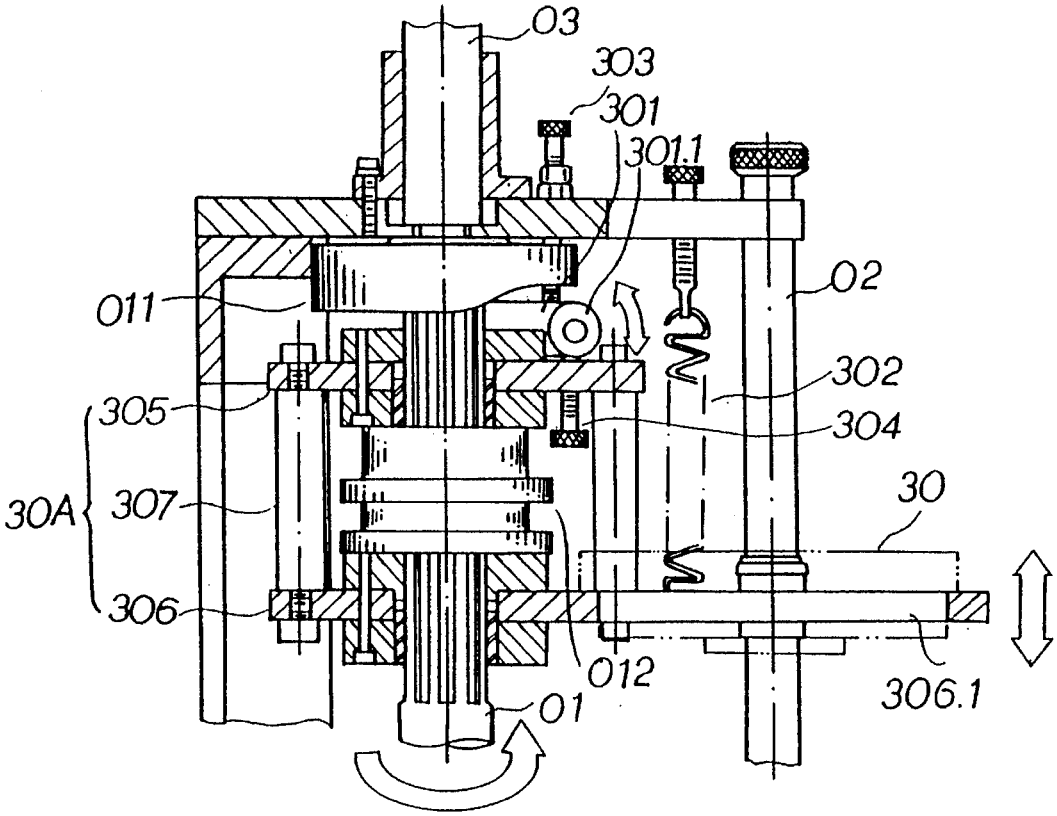
FIG. 4 shows the assembly of the pin insertion cam and embossing mold seat of the present invention.

Please refer to FIG. 4 which shows the embossing mold seat 30A and the relevant elements thereof. The embossing mold seat 30A includes an upper block 305 connected with a lower block 306 by means of several connecting columns 307. The embossing cam 12 is disposed between the upper and lower blocks 305, 306 and the main shaft 1 extends through the three components. The front end of the lower block 306 is fitted on the slide column 2, whereby the embossing mold seat 30A together with the embossing cam 12 is limited by the main shaft 1 and slide column 2 to slide up and down. The front end of the lower block 306 is formed with a mold cavity 306.1 for mounting the embossing mold 30 therein. The embossing mold 30 and embossing cam 12 are moved synchronously along with the embossing mold seat 30A without misdisplacement. The embossing mold seat 30A is slided in such a manner that the pin insertion cam 11 above the upper block 305 drives a roller 301.1 on the swinging arm 301 and by means of the up and down swinging movement of the swinging arm 301, an embossing position adjusting screw 304 fixed on the upper block 305 is used to press down the entire embossing mold seat 30A and a restoring spring 302 upward pulls the embossing mold seat 30A to ensure the driving of the embossing cam 11. This operation is as shown in FIG. 2. The embossing cam 12 starts to work after the clamping means cam 14 is actuated to reach a fixed position, that is, the embossing mold 30 is driven to clamp the wires 12 and then the pin insertion cam 11 works to urge the embossing mold seat 30A to move downward. Meanwhile, the embossing mold 30 pulls the wires downward to complete the pin insertion operation. After the subsequential cutting operation is completed, the operation of the embossing cam 12 ends and the embossing mold 30 releases the wires 12. Thereafter, the operation of the pin insertion cam 11 also ends and the restoring spring 302 makes the embossing mold seat 30A slide back to the upper side. In addition, a wire length adjusting screw 303 is fixed on the machine above the swinging arm 301 to abut against the swinging arm 301 for changing the length of the travel of the embossing mold seat 30A so as to control the length of the wire pulled down each time. The embossing position adjusting screw 304 is used to adjust the level of the embossing mold seat 30A in the same travel so as to change the embossing position of the embossing mold 30.

Figure 5:
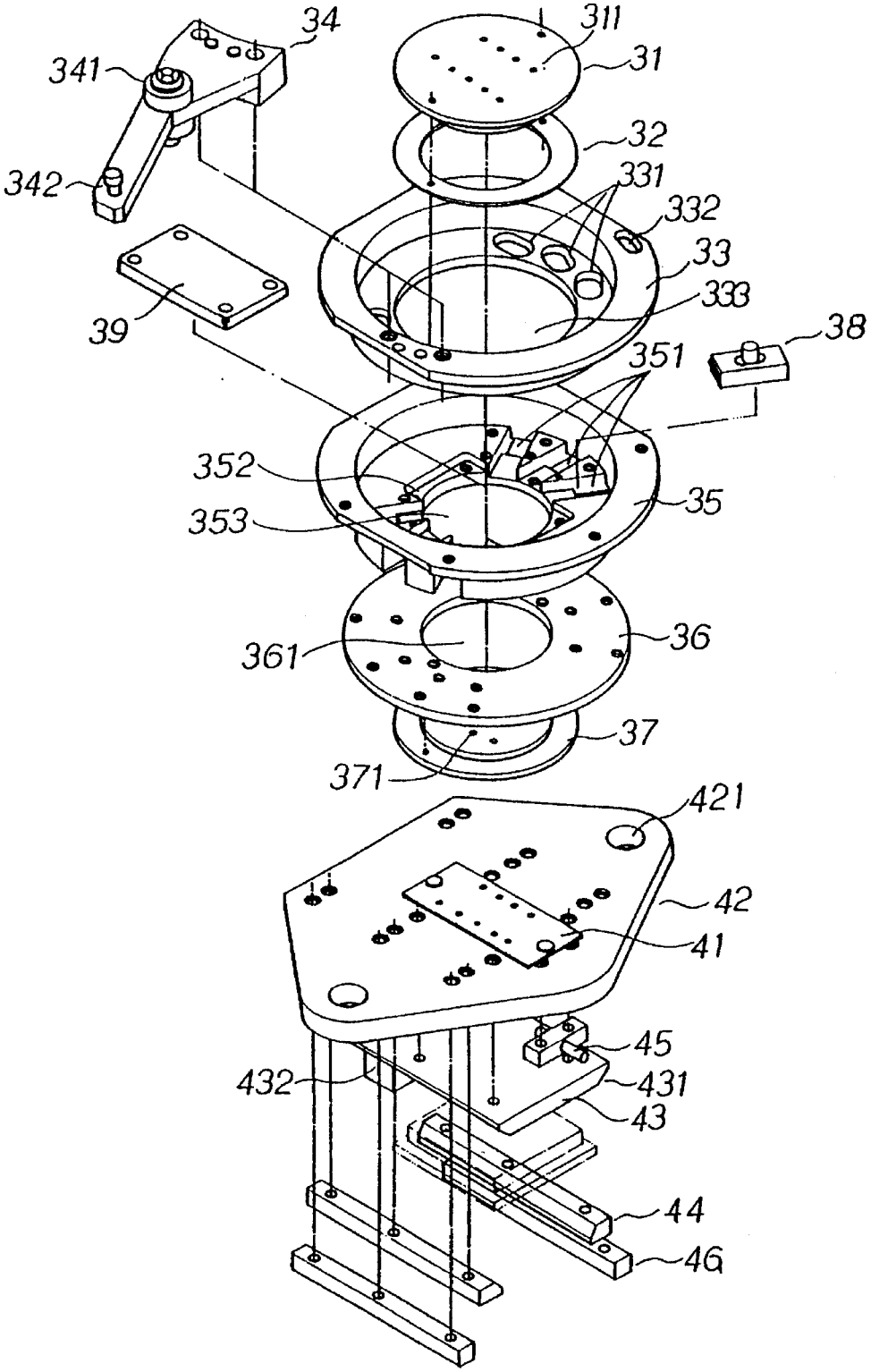
FIG. 5 is a perspective exploded view of the embossing mold and the cutting mold thereof.

Please refer to FIG. 5. The embossing mold 30 includes a rotary sleeve ring 33 fitted in a fixing sleeve ring 35 and a rocking arm 34 driving the rotary sleeve ring 33 to reciprocally rotate and thus the guide hole 331 can drive the embossing blade 38 to move back and forth within the blade slide channel 351. An anvil block seat 352 is disposed at a center of the fixing sleeve ring 35 for receiving an anvil block 39 to cooperate with the embossing blade for squeezing. The embossing blade 38 is limited by the blade fixing disk 36 therebelow and the anvil fixing ring 32 thereunder, whereby the embossing blade 38 is prevented from slipping from the blade slide channel 351 during the clamping operation. The upper wire guiding disk 31 is disposed with a wire guiding hole 311 for guiding the wires 12 to pass through two sides of the anvil block 39 out of the wire guiding hole 371 of the corresponding lower wire guiding disk 37 toward a lower cutting mold 40.

The cutting mold 40 is composed of a blade seat 42, an upper cutting blade 41 and a lower cutting blade 43. The blade seat 42 is a board body and formed with guiding holes 421 on two sides for engaging with the slide column 2. The upper cutting blade 41 is located at a central portion of the blade seat corresponding to the wires 12 and formed with wire guiding holes 411 for the wires to pass therethrough. The lower cutting blade 43 is located closely under the blade seat 42 and formed with guiding holes corresponding to those of the upper cutting blade 41 for receiving the wires 12. Two sides of the lower cutting blade 41 are formed with upward inclined surfaces 431. Slide rails 44 are disposed on outer sides of the inclined surfaces 431 for retaining and making the lower cutting blade 43 slide relative to the upper cutting blade 41 so as to cut off the wires. The lower cutting blade 43 is driven in such a manner that a cam engaging block 432 is disposed on a rear side thereof to be driven by the cutting cam 13 and a position adjusting screw 45 is disposed at a front end thereof to serve as the location standard of the movement of the lower cutting blade 43. In addition, reinforcing ribs 46 are disposed on outer side of the slide rail 44 to share the force exerted on the slide rail 44 and enhance the stability of the lower cutting blade 43.

Figure 6:
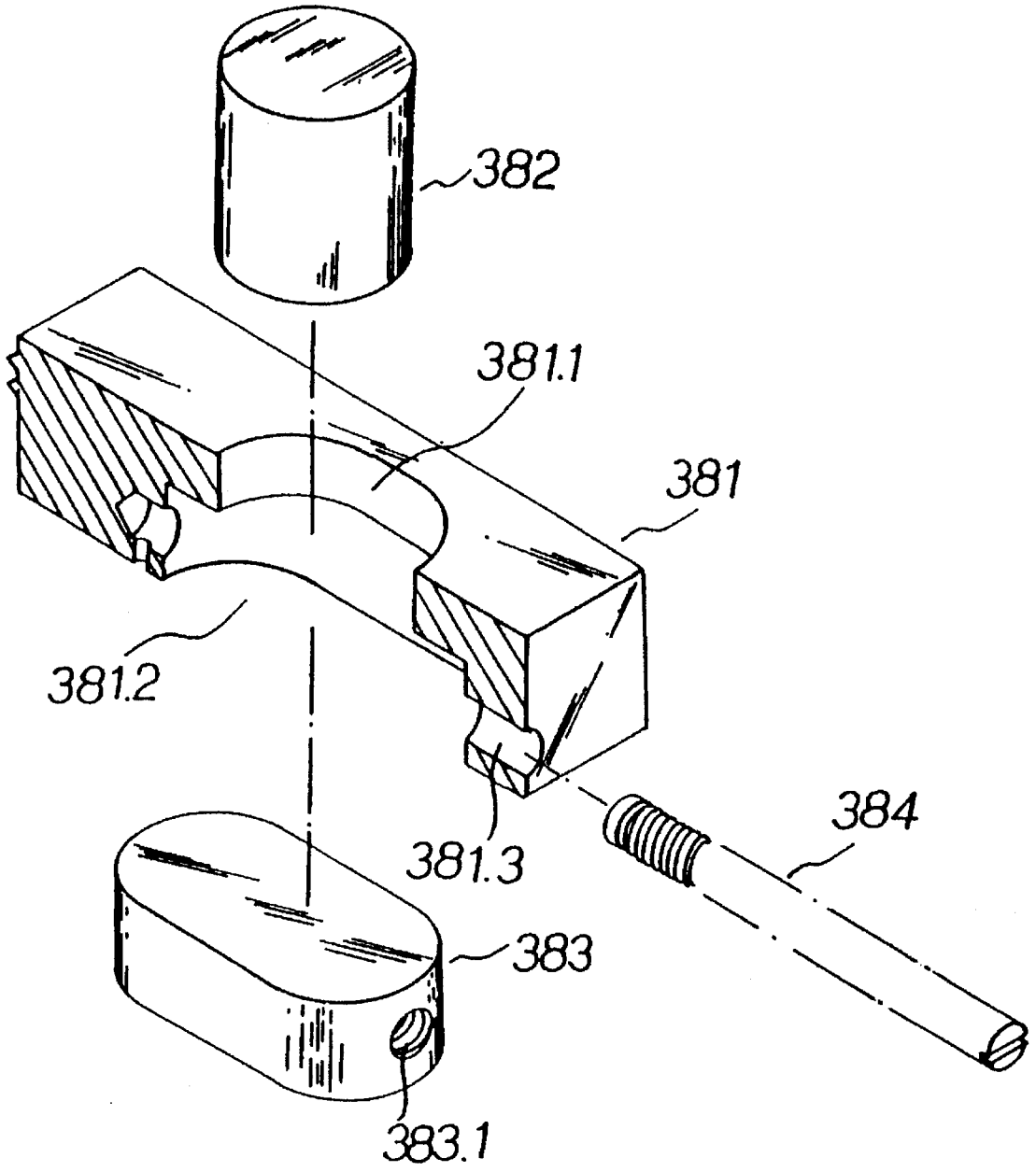
FIG. 6 is a perspective exploded view of the embossing blade thereof.
Figure 7:
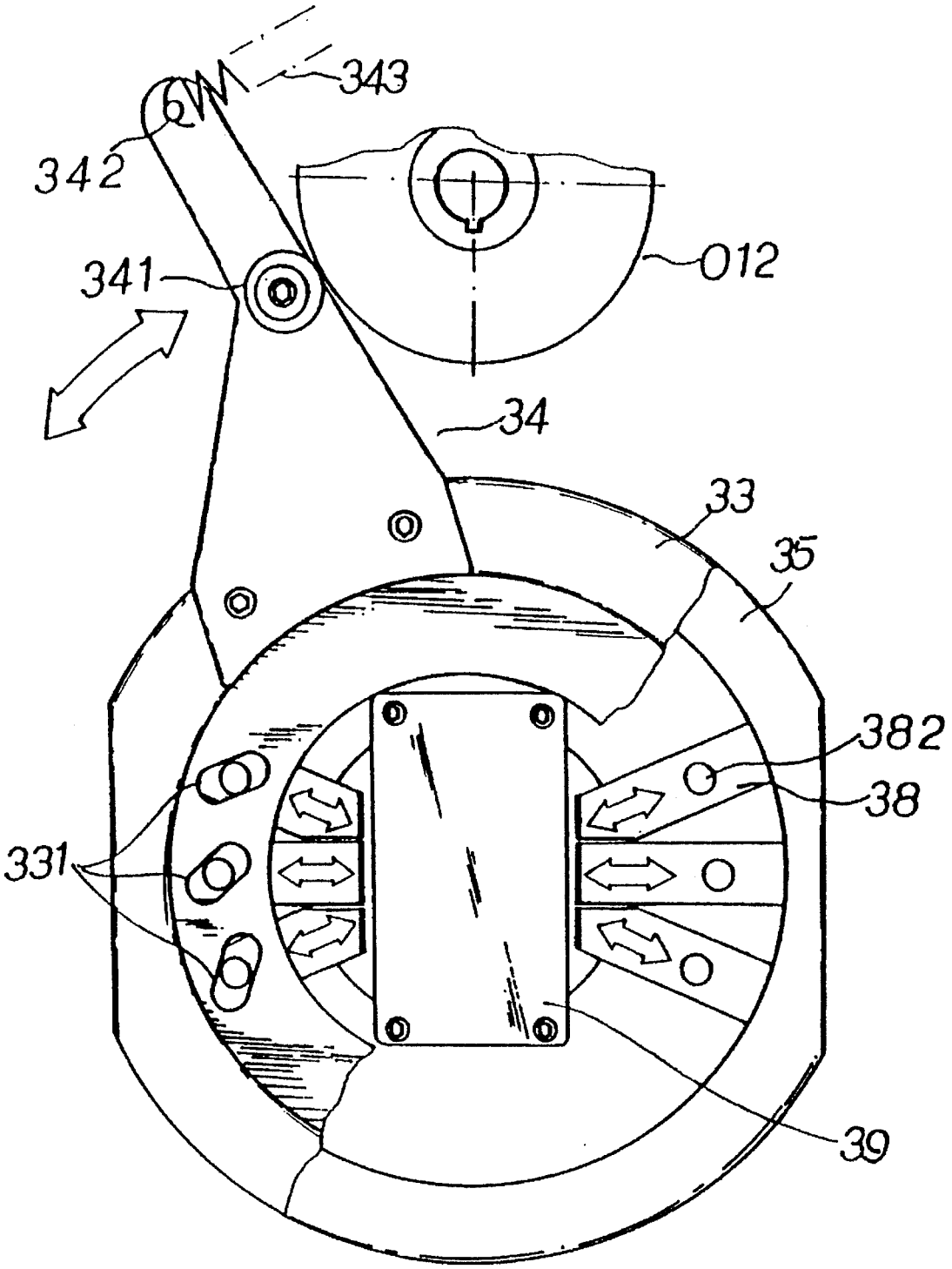
FIG. 7 shows the operation of the embossing mold thereof.

Please refer to FIGS. 6 and 7 for further illustration of the above components. FIG. 6 shows a perspective exploded view of the embossing blade 38 which includes a blade main body 381, projecting post 382 and slide block 383. The blade main body 381 is formed with a lower slide channel 381.2 on the bottom face for slidably receiving the slide block 383 and a relatively short upper slide channel 381.1 for slidably receiving the projecting post 382. The projecting post 382 is fixed on the slide block 383. In addition, the blade main body 381 is formed with a through hole 381.3 passing through the lower slide channel 381.2 in the sliding direction of the central slide block 38.3 in the lower slide channel 381.2. The slide block 383 is formed with a thread hole 383.1 corresponding to the through hole 381.3, whereby a bolt 384 can be passed through the through hole 381.3 to adjust the position of the slide block 383. Therefore, the position of the projecting post 382 relative to the blade main body 381 can be changed, that is, the clearance between the blade main body 381 and the anvil block 39 can Be set to meet the diameter of the wire by means of the bolt 384.

FIG. 7 shows the movement of the embossing mold 30, wherein the rocking arm 34 is associated with the rotary sleeve ring 33 and driven by the cutting cam 12. The restoring spring 343 ensures the-contacting and driving thereof. By means of the reciprocal rotation of the rotary sleeve ring 33, the guiding hole 331 guides the embossing blade 38 to slide back and forth within the blade slide channel 351 so as to complete the embossing operation in cooperation with the anvil block 39 and simultaneously clamp the wire during the pin insertion operation. By means of such embossing operation, the shape of the cross-section and diameter of the wire can be changed so that the pin can be inserted into the work piece, with a greater binding force without departure.

Figure 8:
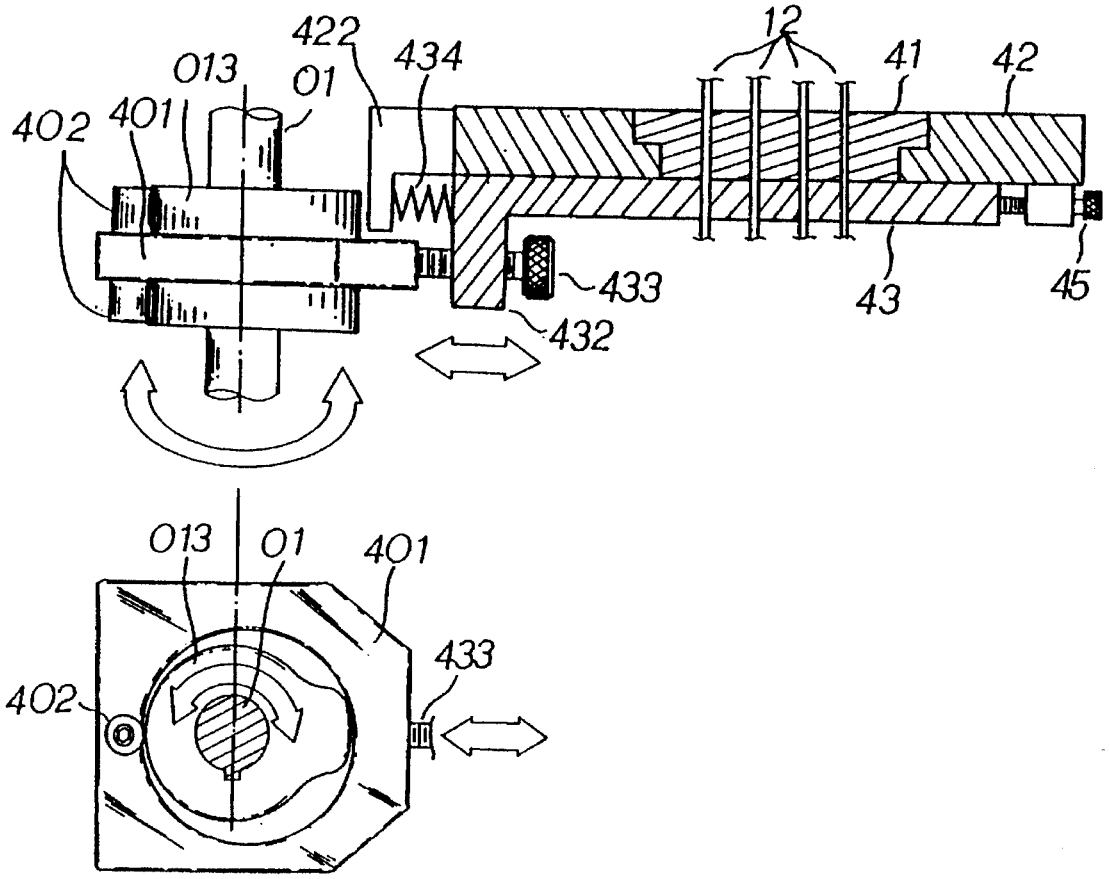
FIG. 8 shows the operation of the cutting mold thereof.

FIG. 8 shows the operation of the cutting mold 40 of the present invention, wherein the lower cutting blade 43 has a cam engaging block 432 at the rear end and a connecting screw 433 disposed thereon to connect with the cam sleeve 401. The cam sleeve 401 is driven by the cutting cam 13 via the roller 402 so as to displace the lower cutting blade 43 relative to the upper cutting blade 41 for cutting off the wires 12. The restoring spring 434 is biased between the rear L-shaped fixing seat 422 of the blade seat 42 and the cam engaging block 432 to ensure that the roller 402 is driven by the cutting cam 13 and the lower cutting blade 43 is biased against the position adjusting screw 45 and truly located when restored.

Figure 9:
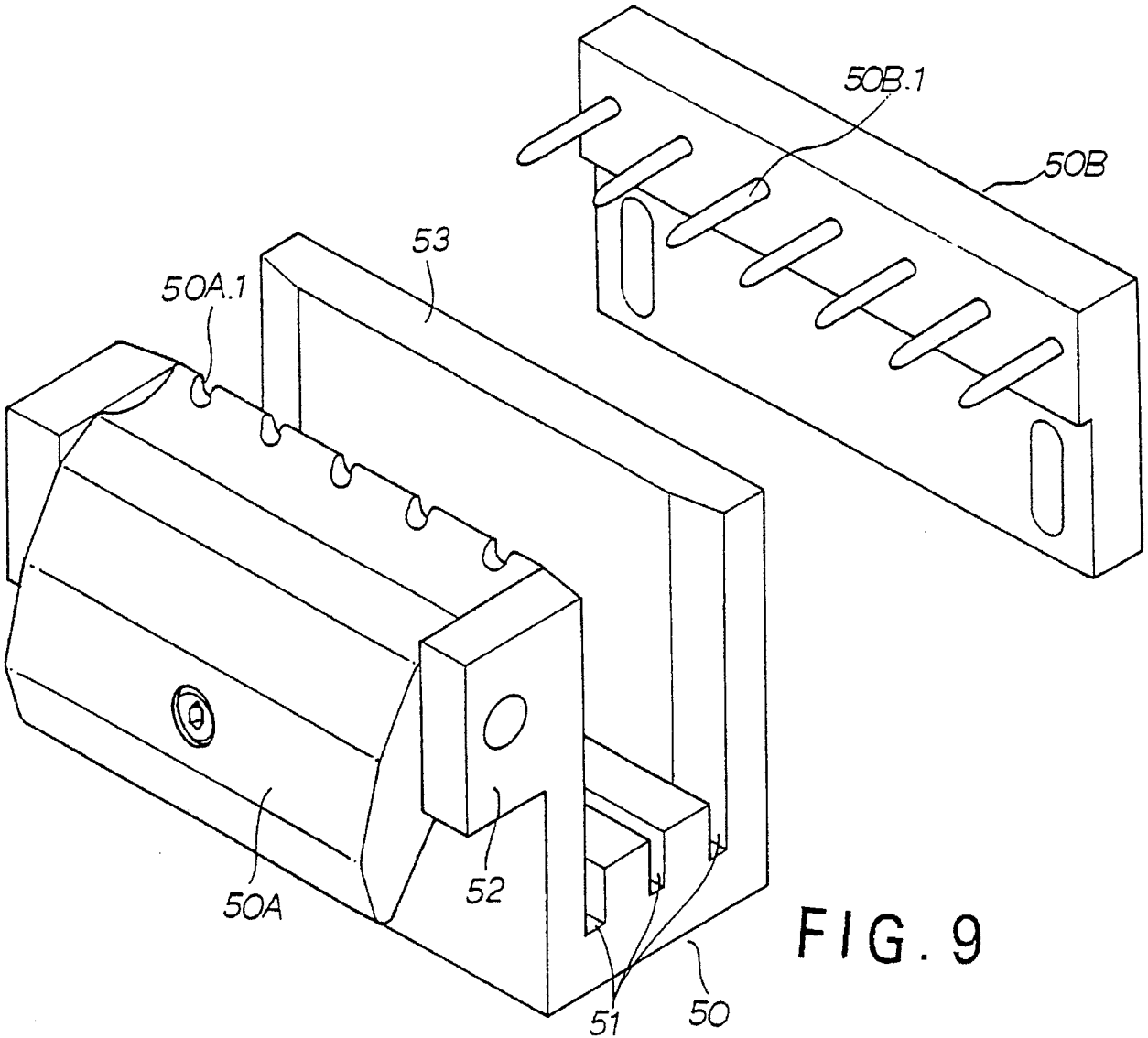
FIG. 9 shows the assembly of the clamping means and the punching molds thereof.

Please refer to FIG. 9 which shows the assembly of the clamping means 50 and the punch molds 50A and 50B. The clamping means 50 is a substantially U-shaped body and formed with different slide channels 51 on the bottom to meet the profiles of the work pieces. In addition, the punch mold 50A is associated with the clamping means 50 on a lateral wall 52 thereof. A restoring spring 503 is disposed therebetween for restoring the punch mold 50A. When it is necessary to pry the lower end of the wire outward through a certain angle, the notches 50A.1 of the punch mold 50A serve to fix the wire and permit the punch mold 50A to pry up the wire. When it is necessary to punch the wire inward through a certain angle, by means of the conic posts 50B.1 of the punch mold 50B corresponding to the wires, the punch mold 50B is driven by a pneumatic cylinder or the like to punch and bend the wires from an upper portion of the lateral wall 53.

Figure 10A:
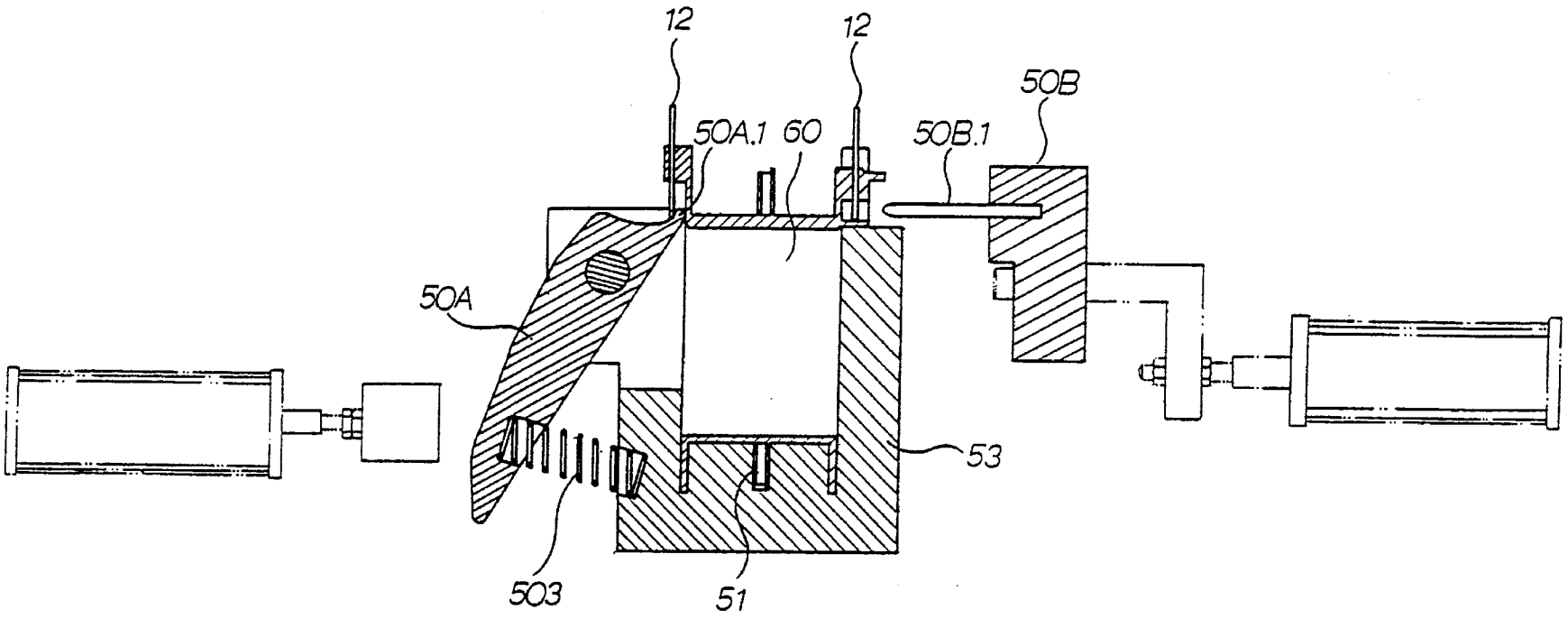
FIGS. 10A and 10B show the operation of the clamping means and punching molds thereof.
Figure 10B:
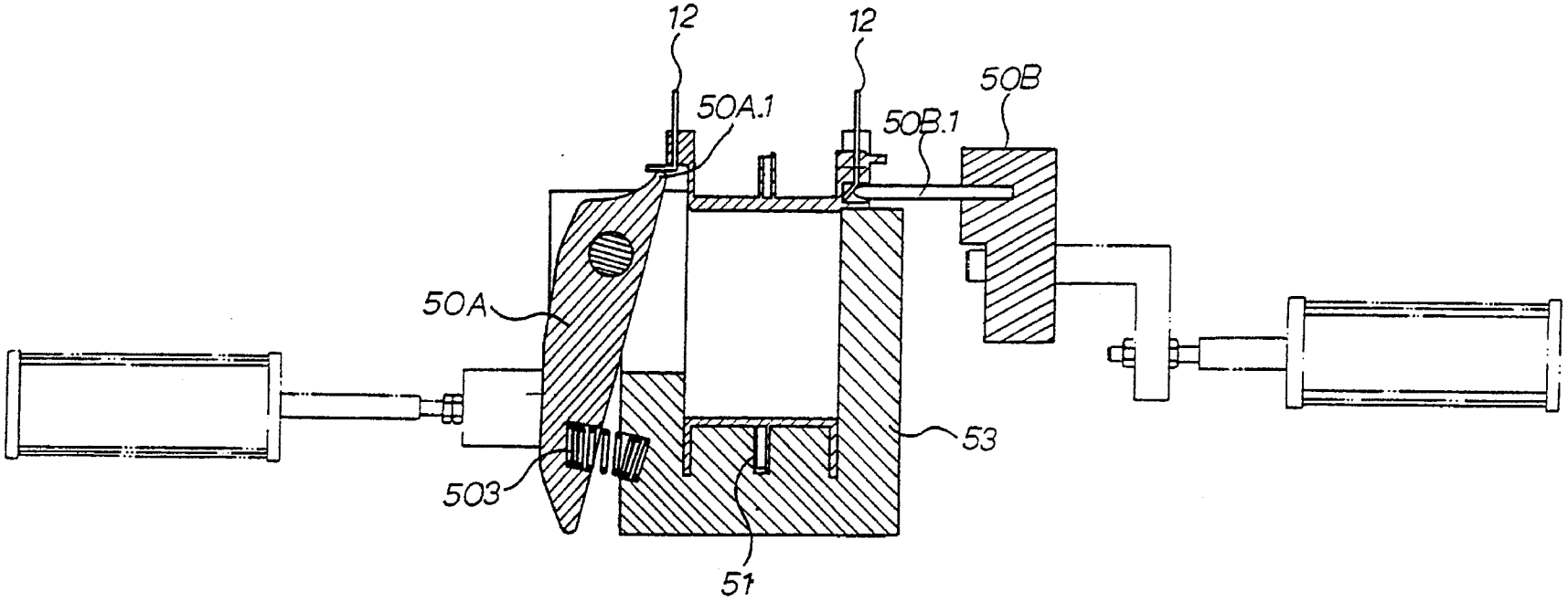

FIGS. 10A and 10B show the operation of the clamping means 50, punch mold 50A and punch mold 50B. FIG. 10A shows a state before the operation, wherein the work, piece 60 is located by means of the slide channel 51 and lateral walls 52, 53 and the punch molds 50A and 50B are to be driven by the pneumatic cylinder. FIG. 10B shows that the punch mold 50A is driven by the pneumatic cylinder to hook and pry the wires by means of the notches 50A.1 through a certain angle. Meanwhile, the punch mold 50B punches the wires by means of the conic posts 50B.1 to bend the wires inward through a certain angle. Therefore, the wires on two sides of the work piece 60 can be processed and molded at one time to save time and labor and also achieve an automatized production for increasing the production efficiency and reducing cost.

Figure 11:
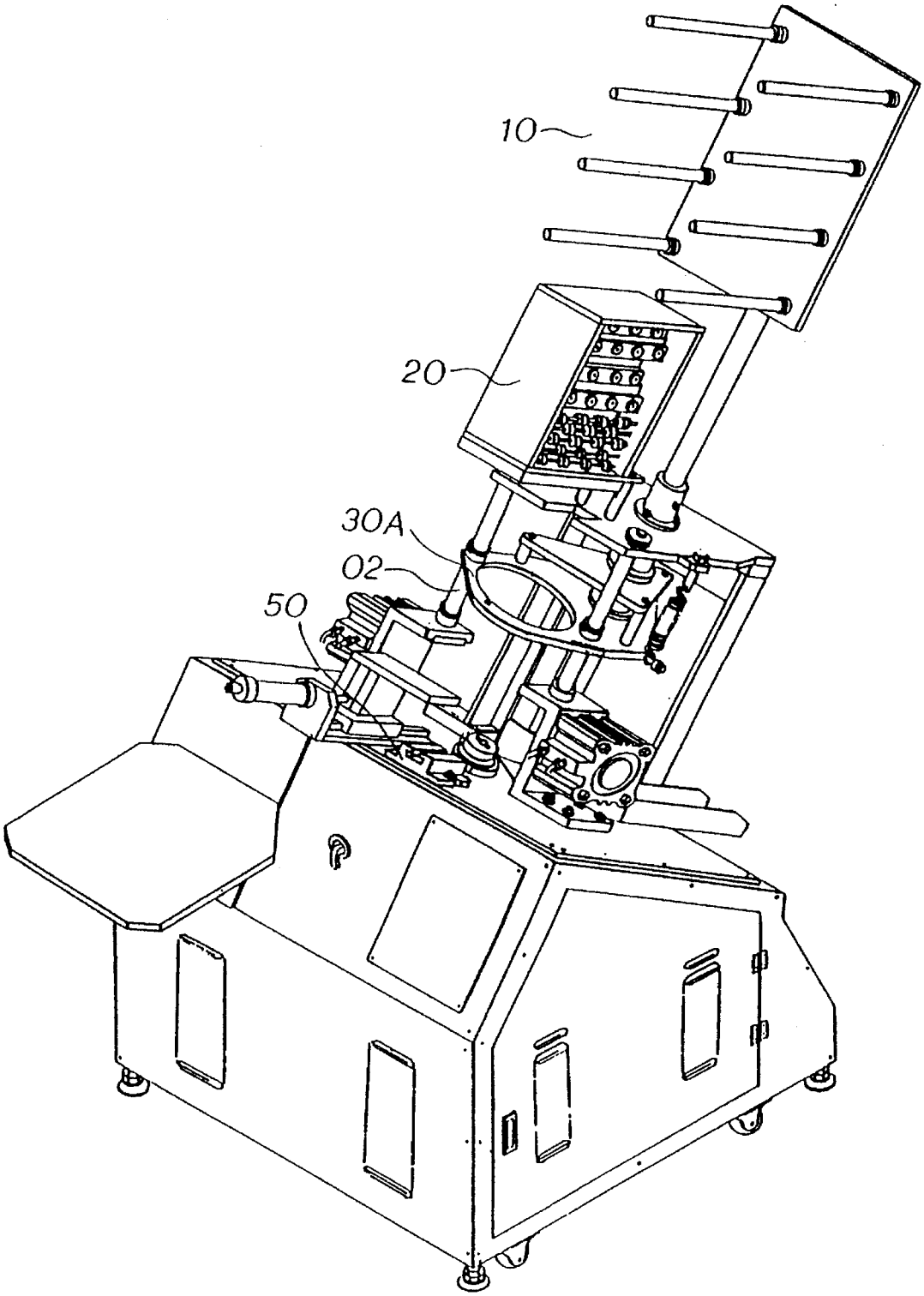
FIG. 11 is a perspective view of the present invention.

FIG. 11 is a perspective view showing the relationship between the respective components of the high speed automatic terminal-pressing machine.

The above embodiment is only an example of the present invention and the scope of the present invention should not be limited to the example. Any modification or variation. derived from the example should fall within the scope of the present invention.

What is claimed is:

1. A high speed automatic terminal-pressing machine for processing terminals of a socket, comprising:

a wire wheel bracket having several separate and fixed shaft members for fitting wire reels thereon, said wire reel bracket being fixed on a table of said machine via a wire reel support arm;

a wire rectifying assembly located behind said wire reel bracket for receiving wires from said wire reels, having several groups of permutated rollers for guiding, rolling on and pressing the wires into a straight state;

an embossing mold located behind said wire rectifying assembly for receiving wires therefrom and embossing the wires so as to increase the binding force thereof when inserted into a work piece, said embossing mold including several embossing blades and an anvil block, each of said embossing blades having a projecting post for easily driving said embossing blade, a driving mechanism being used to drive said embossing blades to displace relative to said anvil block so as to emboss the wires, another driving mechanism being used to drive said embossing mold to move up and down so as to insert the wires into the work piece;

a cutting mold located behind said embossing mold for receiving the wires therefrom and guiding the embossed wires to be inserted into the work piece as well as cutting off the wires to separate the semiproduce from the wires, said cutting mold including an upper cutting blade and a lower cutting blade both of which are formed with holes corresponding to the wires for receiving the same, a driving mechanism being used to drive said upper and lower cutting blades to slide relative to each other to create a shearing force on adjacent faces for cutting off the wires; and a clamping means disposed behind said cutting mold for insertion of the embossed wires, including a channel-shaped clamping member corresponding to the work piece, a driving mechanism being used to drive said clamping means to move up and down so as to get close to or away from said cutting mold for insertion or withdrawal of the wires in the work piece, said terminal-pressing machine being characterized in that said driving mechanisms of said embossing mold, cutting mold and clamping means are driven by a main driving device to synchronously operate in a specifically relatedly sequence, whereby the relative up and down and clamping movement of the embossing mold, cutting movement of the cutting mold and the up and down movement of the clamping means are performed in a predetermined sequence and the wire embossing, insertion and cutting steps of the processing procedure of the work piece are accomplished in a unified and automatic manner.

2. A terminal-pressing machine as claimed in claim 1, wherein said embossing mold is fixed on an embossing mold seat and at least one slide column is fixed on the table of said machine in parallel to main driving shaft, said embossing mold seat being limited by said main shaft and slide column and driven by said mechanism to axially parallelly reciprocate, said embossing mold seat being formed with a mold cavity for inserting said embossing mold therein to suit different permutation patterns of the wires for different work pieces.

3. A terminal-pressing machine as claimed in claim 1, wherein said cutting mold includes a board-like blade seat formed with a hole for receiving said upper cutting blade, a pair of parallel slide rails being disposed under said blade seat for said lower cutting blade to slide therealong, whereby said upper and lower cutting blades are replaceable to suit different permutation patterns of the wires for different work pieces.

4. A terminal-pressing machine as claimed in claim 1, wherein said clamping member is a U-shaped member formed with slide channels on the bottom thereof corresponding to the work piece, whereby the work piece can be mounted in or detached from the slide channels, the driving mechanism for said clamping means having an abutting rod connected with said clamping means, whereby said clamping means is replaceable to suit different permutation patterns of the wires for different work pieces.

5. A terminal-pressing machine as claimed in claim 1, wherein said wire reel support arm for fixing said wire reel bracket is inclined by a certain angle whereby the wire reels are fitted on said wire reel bracket without slipping due to rotation.

6. A terminal-pressing machine as claimed in claim 1, wherein said embossing blade has a slide channel in the moving direction and a bolt passes through a slide block to be fixed in said slide channel, a projecting post being fixed on said slide block, whereby said bolt is used to adjust the position of said slide block so as to change the relative position of said projecting post to said embossing blade and thus adjust the distance between said embossing blade and said anvil to emboss different wires.

7. A terminal-pressing machine as claimed in claim 1, wherein said embossing mold has a fixing sleeve ring and a rotary sleeve ring, said fixing sleeve ring being formed with several diametric blade slide channels and a central anvil seat, said rotary sleeve ring being fitted on said fixing sleeve ring and formed with slant guiding holes corresponding to said blade slide channels, whereby said rotary sleeve ring is driven by said driving mechanism to reciprocally rotate so as to make the guiding holes guide said embossing blade to reciprocate within said blade slide channels for embossing operation.

8. A terminal-pressing machine as claimed in claim 2, wherein an embossing position adjusting screw is disposed between said embossing mold seat and said axially moving driving mechanism to abut against the same, said embossing position adjusting screw being used to adjust the level of said embossing mold in the axial travel so as to determine the embossing position of the wires.

9. A terminal-pressing machine as claimed in claim 2, wherein said axially moving driving mechanism includes a cam fixed on the main shaft and a rocking arm pivotally connected on the table, a roller being disposed at a front end of said rocking arm, whereby said cam drives said rocking arm to swing up and down to drive said embossing mold seat, a wire length adjusting screw being fixed on said table in the moving path of said rocking arm, whereby the length of rocking arm at which said wire length adjusting screw abuts determines the length of the travel of said embossing mold seat, whereby the length of the pulled wires in each travel of said embossing mold seat can be adjusted.

10. A terminal-pressing machine as claimed in claim 3, wherein said blade seat of said cutting mold is fixed under said embossing mold, whereby said driving mechanism drives said lower cutting blade to relatively displace so as to complete the cutting operation.

11. A terminal-pressing machine as claimed in claim 1, wherein said clamping means cooperates with a first punching mold and a second punching mold, said first punching mold being connected on a lateral wall of said clamping means and having a tapered top end, several notches being formed on a ridge of said tapered top end corresponding to the work piece for prying the wires outward through a certain angle, said second punching mold being fixed on said driving mechanism for punching operation and disposed with several conic posts facing the work piece corresponding to the wires for punching and bending the wires inward through a certain angle.

12. A terminal-pressing machine as claimed in claim 2, wherein said embossing blade has a slide channel in the moving direction and a bolt passes through a slide block to be fixed in said slide channel, a projecting post being fixed on said slide block, whereby said bolt is used to adjust the position of said slide block so as to change the relative position of said projecting post to said embossing blade and thus adjust the distance between said embossing blade and said anvil to emboss different wires.

13. A terminal-pressing machine as claimed in claim 2, wherein said embossing mold has a fixing sleeve ring and a rotary sleeve ring, said fixing sleeve ring being formed with several diametric blade slide channels and a central anvil seat, said rotary sleeve ring being fitted on said fixing sleeve ring and formed with slant guiding holes corresponding to said blade slide channels, whereby said rotary sleeve ring is driven by said driving mechanism to reciprocally rotate so as to make the guiding holes guide said embossing blade to reciprocate within said blade slide channels for embossing operation.

14. A terminal-pressing machine as claimed in claim 2, wherein said clamping means cooperates with a first punching mold and a second punching mold, said first punching mold being connected on a lateral wall of said clamping means and having a tapered top end, several notches being formed on a ridge of said tapered top end corresponding to the work piece for prying the wires outward through a certain angle, said second punching mold being fixed on said driving mechanism for punching operation and disposed with several conic posts facing the work piece corresponding to the wires for punching and bending the wires inward through a certain angle.

15. A terminal-pressing machine as claimed in claim 3, wherein said clamping means cooperates with a first punching mold and a second punching mold, said first punching mold being connected on a lateral wall of said clamping means and having a tapered top end, several notches being formed on a ridge of said tapered top end corresponding to the work piece for prying the wires outward through a certain angle, said second punching mold being fixed on said driving mechanism for punching operation and disposed with several conic posts facing the work piece corresponding to the wires for punching and bending the wires inward through a certain angle.

16. A terminal-pressing machine as claimed in claim 4, wherein said clamping means cooperates with a first punching mold and a second punching mold, said first punching mold being connected on a lateral wall of said clamping means and having a tapered top end, several notches being formed on a ridge of said tapered top end corresponding to the work piece for prying the wires outward through a certain angle, said second punching mold being fixed on said driving mechanism for punching operation and disposed with several conic posts facing the work piece corresponding to the wires for punching and bending the wires inward through a certain angle.

* * * * *